US010280704B2

(12) United States Patent
Vasques et al.

(10) Patent No.: US 10,280,704 B2
(45) Date of Patent: May 7, 2019

(54) ANNULAR BARRIER WITH PASSIVE PRESSURE COMPENSATION

(71) Applicant: Welltec Oilfield Solutions AG, Zug (CH)

(72) Inventors: Ricardo Reves Vasques, Allerød (DK); Dean Richard Massey, Allerød (DK)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 284 days.

(21) Appl. No.: 15/028,982

(22) PCT Filed: Nov. 20, 2014

(86) PCT No.: PCT/EP2014/075129
§ 371 (c)(1),
(2) Date: Apr. 13, 2016

(87) PCT Pub. No.: WO2015/075118
PCT Pub. Date: May 28, 2015

(65) Prior Publication Data

US 2016/0273298 A1 Sep. 22, 2016

(30) Foreign Application Priority Data

Nov. 21, 2013 (EP) ..... 13193848

(51) Int. Cl.
*E21B 33/127* (2006.01)
*E21B 33/12* (2006.01)

(52) U.S. Cl.
CPC ..... *E21B 33/127* (2013.01); *E21B 33/1208* (2013.01); *E21B 33/1277* (2013.01)

(58) Field of Classification Search
CPC . E21B 33/127; E21B 33/1277; E21B 33/1208
See application file for complete search history.

(56) References Cited

U.S. PATENT DOCUMENTS 2,736,261 A * 2/1956 Davis ..... F42B 3/06 102/326
4,846,278 A 7/1989 Robbins
(Continued)

FOREIGN PATENT DOCUMENTS

| | | |
|---|---|---|
| EP | 2 312 119 | 4/2011 |
| WO | 2010/146374 A2 | 12/2010 |
| WO | WO 2012/136258 | 10/2012 |

OTHER PUBLICATIONS

International Search Report for PCT/EP2014/075129 dated May 15, 2015, 3 pages.

(Continued)

*Primary Examiner* — David J Bagnell
*Assistant Examiner* — Jonathan Malikasim
(74) *Attorney, Agent, or Firm* — Nixon & Vanderhye P.C.

(57) ABSTRACT

The present invention relates to an annular barrier to be expanded in an annulus between a well tubular structure and an inside wall of a borehole downhole for providing zone isolation between a first zone and a second zone of the borehole, the annular barrier comprising a tubular metal part for mounting as part of the well tubular structure, an expandable sleeve surrounding the tubular metal part and having an inner face facing the tubular metal part and an outer face facing the inside wall of the borehole, each end of the expandable sleeve being connected with the tubular metal part, and an annular space between the inner face of the expandable sleeve and the tubular metal part, wherein the tubular part and the inner face of the expandable sleeve substantially hermetically enclose the annular space, the annular space comprising a compound adapted to expand the annular space, and wherein the expandable sleeve comprises two first sections abutting the ends of the expandable sleeve and a second section between the first sections, the first section of the expandable sleeve has a first inner diameter in (Continued)

an unexpanded condition of the annular barrier, and the second section of the expandable sleeve has a second inner diameter in the unexpanded condition, which second inner diameter is larger than the first inner diameter in the unexpanded condition, or the first sections have a first thickness which is larger than a second thickness of the second section in the unexpanded condition. Furthermore, the invention relates to a downhole system and a method of expanding an annular barrier.

23 Claims, 14 Drawing Sheets

(56) References Cited

U.S. PATENT DOCUMENTS 5,718,292 A * 2/1998 Heathman ..... E21B 33/1277 166/187
7,673,692 B2 * 3/2010 Kunz ..... E21B 33/1277 166/122
7,828,068 B2 * 11/2010 Gano ..... E21B 33/12 166/207
2010/0252254 A1 10/2010 Nutley et al.
2011/0094756 A1 4/2011 Corbett et al.
2011/0266004 A1 * 11/2011 Hallundbaek ..... E21B 33/1208 166/369
2013/0056209 A1 * 3/2013 Mazyar ..... E21B 33/1208 166/302
2013/0186615 A1 * 7/2013 Hallundbaek ..... E21B 33/127 166/120

OTHER PUBLICATIONS

Written Opinion of the ISA for PCT/EP2014/075129 dated May 15, 2015, 7 pages.
Extended European Search Report dated Feb. 25, 2014 issued in European Application No. 13193848.2 (7 pages).

* cited by examiner

ANNULAR BARRIER WITH PASSIVE PRESSURE COMPENSATION

This application is the U.S. national phase of International Application No. PCT/EP2014/075129 filed 20 Nov. 2014 which designated the U.S. and claims priority to EP 13193848.2 filed 21 Nov. 2013, the entire contents of each of which are hereby incorporated by reference.

FIELD OF THE INVENTION

The present invention relates to an annular barrier to be expanded in an annulus between a well tubular structure and an inside wall of a borehole downhole for providing zone isolation between a first zone and a second zone of the borehole. Furthermore, the invention relates to a downhole system and a method of expanding an annular barrier.

BACKGROUND ART

When completing a well, production zones are provided by submerging a casing string having annular barriers into a borehole or a casing of the well. When the casing string is in the right position in the borehole, the annular barriers are expanded or inflated. The annular barriers are in some completions expanded by pressurised fluid, which requires a certain amount of additional energy.

In other completions, a compound inside the annular barrier is heated so that the compound becomes gaseous, hence increasing its volume and thus expanding the expandable sleeve. However, the diameter of a borehole or a casing may vary, and when the sleeve is expanded, the sleeve may damage the formation or collapse the casing if the diameter of the borehole is smaller than expected, i.e. an excess of expansion energy occurs. Furthermore, the sleeve of the known annular barriers may also fracture if the expansion energy is higher than required.

SUMMARY OF THE INVENTION

It is an object of the present invention to wholly or partly overcome the above disadvantages and drawbacks of the prior art. More specifically, it is an object to provide an improved annular barrier comprising a compound in an expandable space, where said annular barrier is capable of fitting a range of inner diameters of the borehole in which it is arranged, without the sleeve fracturing.

The above objects, together with numerous other objects, advantages and features, which will become evident from the below description, are accomplished by a solution in accordance with the present invention by an annular barrier to be expanded in an annulus between a well tubular structure and a wall of a borehole downhole for providing zone isolation between a first zone and a second zone of the borehole, the annular barrier comprising:

- a tubular metal part for mounting as part of the well tubular structure,
- an expandable sleeve surrounding the tubular metal part and having an inner face facing the tubular metal part and an outer face facing the inside wall of the borehole, each end of the expandable sleeve being connected with the tubular metal part, and
- an annular space between the inner face of the expandable sleeve and the tubular metal part, wherein the tubular part and the inner face of the expandable sleeve substantially hermetically enclose the annular space, the annular space comprising a compound adapted to expand the annular space, and wherein the expandable sleeve comprises two first sections abutting the ends of the expandable sleeve and a second section between the first sections, each first sections of the expandable sleeve has a first inner diameter in an unexpanded condition of the annular barrier, and the second section of the expandable sleeve has a second inner diameter in the unexpanded condition, which second inner diameter is larger than the first inner diameter in the unexpanded condition, or the first sections have a first thickness which is larger than a second thickness of the second section in the unexpanded condition.

The compound may be adapted to expand the annular space when subjected to heat.

When having an expandable sleeve with a first inner diameter which is smaller than a second inner diameter or a first thickness which may be larger than a second thickness of the second section, the pressure for expanding the sleeve section having the first inner diameter or the first thickness is higher than the pressure required for expanding the section with the second inner diameter or second thickness. The compound in the annular space generates a certain amount of expansion energy, and if the inner diameter of the borehole is smaller than expected at a location where the annular barrier is to be expanded, there we will be an excess of expansion energy. This excess of expansion energy can then be used to also expand the section of the sleeve with the smaller inner diameter or the smaller thickness. Thus, the first sections of the sleeve function as a passive pressure compensation function since expansion of this section occurs when there is an excess of expansion energy.

The first sections may have an increasing thickness.

Moreover, the second inner diameter may at least 0.5 mm larger than the first inner diameter, preferably at least 1 mm larger than the first inner diameter, more preferably at least 2 mm larger than the first inner diameter.

The compound may comprise at least one thermally decomposable compound adapted to generate gas or supercritical fluid upon decomposition, the thermally decomposable compound decomposing at a temperature below 400° C.

Further, the ends of the expandable sleeve may be welded to the tubular part.

Thus, the risk of leaks is further diminished.

The ends mentioned of the expandable sleeve mentioned above may be connected to the tubular part by means of connection parts.

Additionally, the ends of the expandable sleeve may be crimped onto the tubular part.

Moreover, the first thickness may be at least 15% larger than the second thickness, preferably 25% larger than the second thickness, more preferably 50% larger than the second thickness.

Furthermore, the expandable sleeve may comprise a transition section between the first section and the second section, the transition section having an increasing thickness from the second section to the first section.

The expandable sleeve may also comprise a third section between the first section and the second section, the third section having a third thickness which may be smaller than the first thickness and larger than the second thickness.

Further, the expandable sleeve may comprise a transition section between the second section and the third section and a transition section between the third section and the first section.

All sections of the expandable sleeve may be made of the same material.

Also, the sections of the expandable sleeve may be made when making the expandable sleeve.

In addition, the sections of the expandable sleeve may further be fabricated as one piece.

Sealing elements may be arranged on the outer face of the expandable sleeve.

Moreover, the ends of the expandable sleeve may be sandwiched between the connection parts and the tubular part.

Furthermore, the second section may be adapted to expand at a first pressure above 300 bar, preferably above 325 bar, more preferably at a pressure of approximately 345 bar, and the first sections may be adapted to expand at a second pressure which may be higher than the first pressure.

Thus, the first pressure may be at least 65 bar, preferably at least 100 bar, more preferably at least 150 bar, most preferably at least 250 bar.

The second pressure mentioned above may be at least 100 bar, more preferably at least 250 bar, most preferably at least 350 bar.

The third section may be adapted to expand at a third pressure which may be higher than the first pressure and smaller than the second pressure.

Also, a one-way valve may be arranged in the tubular part.

Further, the tubular part may not have any openings, holes or apertures into the annular space.

Additionally, the tubular part may comprise an outer face, the outer face being continuous.

Furthermore, the compound may comprise nitrogen.

The compound may be selected from a group consisting of: ammonium dichromate, ammonium nitrate, ammonium nitrite, barium azide, sodium nitrate, or a combination thereof.

Moreover, the compound may decompose at temperatures above 100° C., preferably above 180° C.

Also, the annular space may be pre-pressurised to a pressure above 5 bar, preferably above 50 bar and more preferably above 100 bar, even more preferably above 250 bar.

The compound described above may be present in the form of a powder, a powder dispersed in a liquid or a powder dissolved in a liquid.

The annular barrier according to the invention may further comprise a heating wire arranged in the tubular metal part or in an abutment to the tubular metal part.

Also, the annular barrier may comprise a pressure compensation unit fluidly connected with the space.

The pressure compensation unit may be a hollow tube closed in one end and arranged along the tubular part and connected with the connection part.

Additionally, the annular barrier may comprise an anti-collapsing element arranged in the space.

The anti-collapsing element may be coiled around the tubular part.

The anti-collapsing element mentioned above may be a helical spring.

The invention also relates to a downhole system comprising:

a well tubular structure, and an annular barrier according to the invention.

The downhole system mentioned above may further comprise a plurality of annular barriers.

Moreover, the well tubular structure may be filled with a fluid having a temperature above 110° C., preferably a temperature above 180° C., and more preferably a temperature above 250° C.

The downhole system as described above may further comprise a tool comprising a heating unit for heating the tubular metal part of the annular barrier from within the well tubular structure.

Further, the tool may comprise isolation means for isolating a zone in the well tubular structure opposite the expandable space of the annular barrier.

Additionally, the heating unit of the tool may comprise a heating wire adapted to be arranged in abutment to the tubular metal part.

Furthermore, the tool may comprise a positioning device, such as a magnetic profiler or a casing collar locator.

Also, the tool may be adapted to abut the one-way valve in the tubular metal part to provide heat to the annular space through the one-way valve.

The well tubular structure may be connected with a heating device at surface or seabed.

Moreover, the well tubular structure may be connected to a tubing, such as a drill pipe, for submerging the well tubular structure, the tubing being connected with a heating device at surface or seabed.

The invention further relates to a method of expanding an annular barrier according to the invention comprising the steps of:

activating the compound in the annular space so that the annular space starts to expand, thereby causing the second section of the expandable sleeve to expand by a first pressure, and expanding the first sections of the expandable sleeve if the first pressure exceeds a second pressure.

Said step of activating the compound may comprise the steps of providing heat to the annular space, decomposing the thermally decomposable compound present in the annular space, and generating gas or super-critical fluid.

The method of expanding an annular barrier as described above may further comprise the step of filling the expandable space with at least one thermally decomposable compound, which compound is thermally decomposable below 400° C.

Also, the method as described above may further comprise the step of mounting the tubular metal part as part of the well tubular structure.

Said method may further comprise the step of isolating a zone opposite the opening of the annular barrier by means of a tool.

Moreover, the method of expanding an annular barrier as described above may further comprise the step of heating the pressurising fluid with the zone.

Further, the tool may comprise a pump for pressurising the fluid.

Finally, the tool may be connected by tubing to a pump arranged at surface or seabed.

Finally, the present invention relates to a method of compensating for a varying borehole diameter when expanding an annular barrier as described above, comprising the steps of:

activating the predetermined amount of compound in the annular space, expanding the annular space and the second section of the expandable sleeve, and compensating for a varying borehole diameter by expanding also the first sections of the expandable sleeve.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
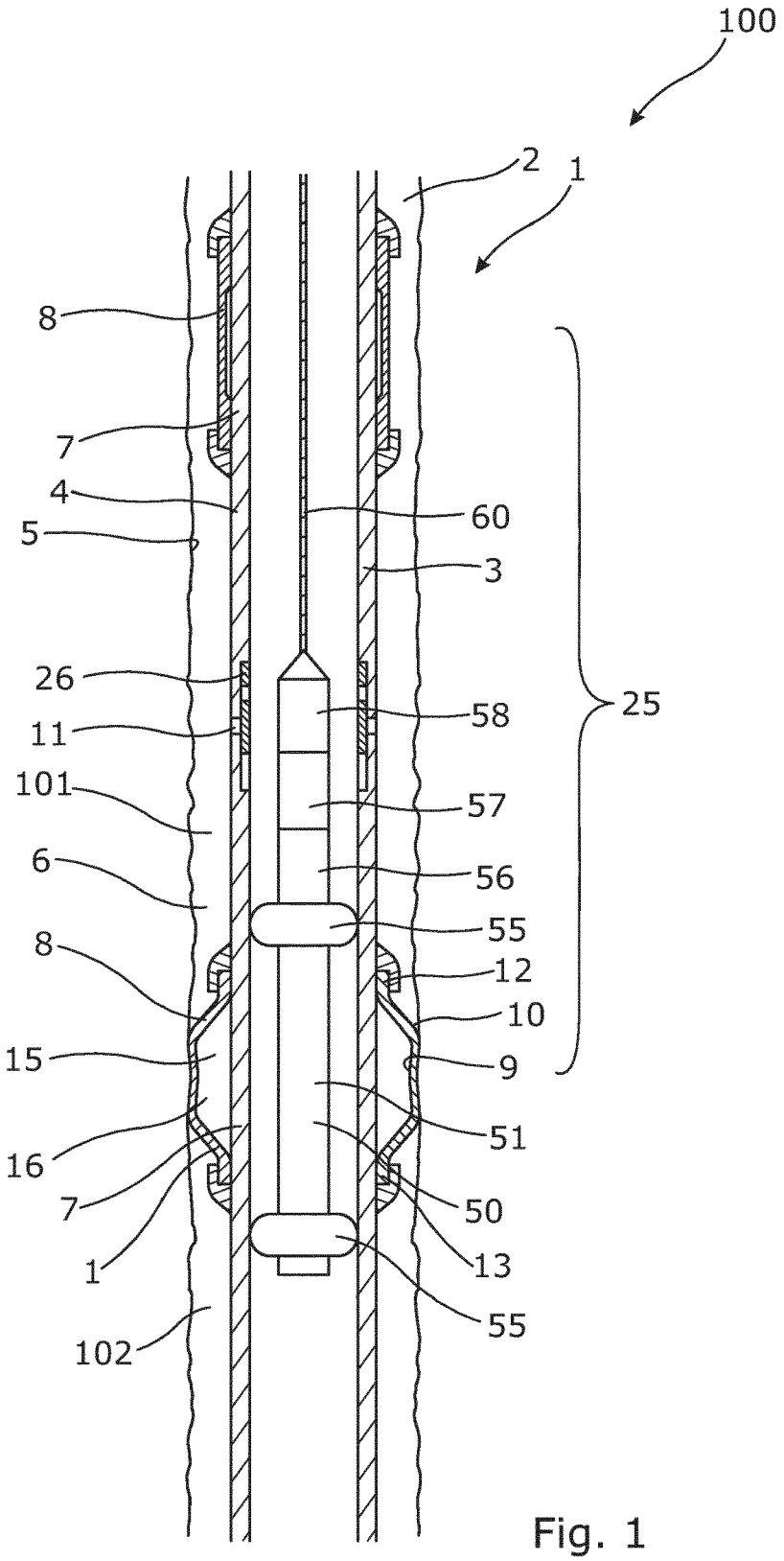
FIG. 1 shows a downhole system having a well tubular structure and annular barriers.

FIG. 1 shows an annular barrier 1 to be expanded in an annulus 2 between a well tubular structure 3 and an inside wall 5 of a borehole 6 downhole for providing zone isolation between a first zone 101 and a second zone 102 of the borehole 6. The annular barrier may also be arranged in a casing and may also be used as an anchor of the well tubular structure. In the following, the invention will be disclosed in relation to implementation directly in a borehole. The annular barrier 1 comprises a tubular metal part 7 for mounting as part of the well tubular structure 3, and an expandable sleeve 8 surrounding the tubular metal part 7. The expandable sleeve 8 has an inner face 9 facing the tubular metal part 7 and an outer face 10 facing the inside wall 5 of the borehole 6. Each end 12, 13 of the expandable sleeve 8 is connected with the tubular metal part 7 defining an annular space 15 between the inner face 9 of the expandable sleeve 8 and the tubular metal part 7.

Figure 2A:
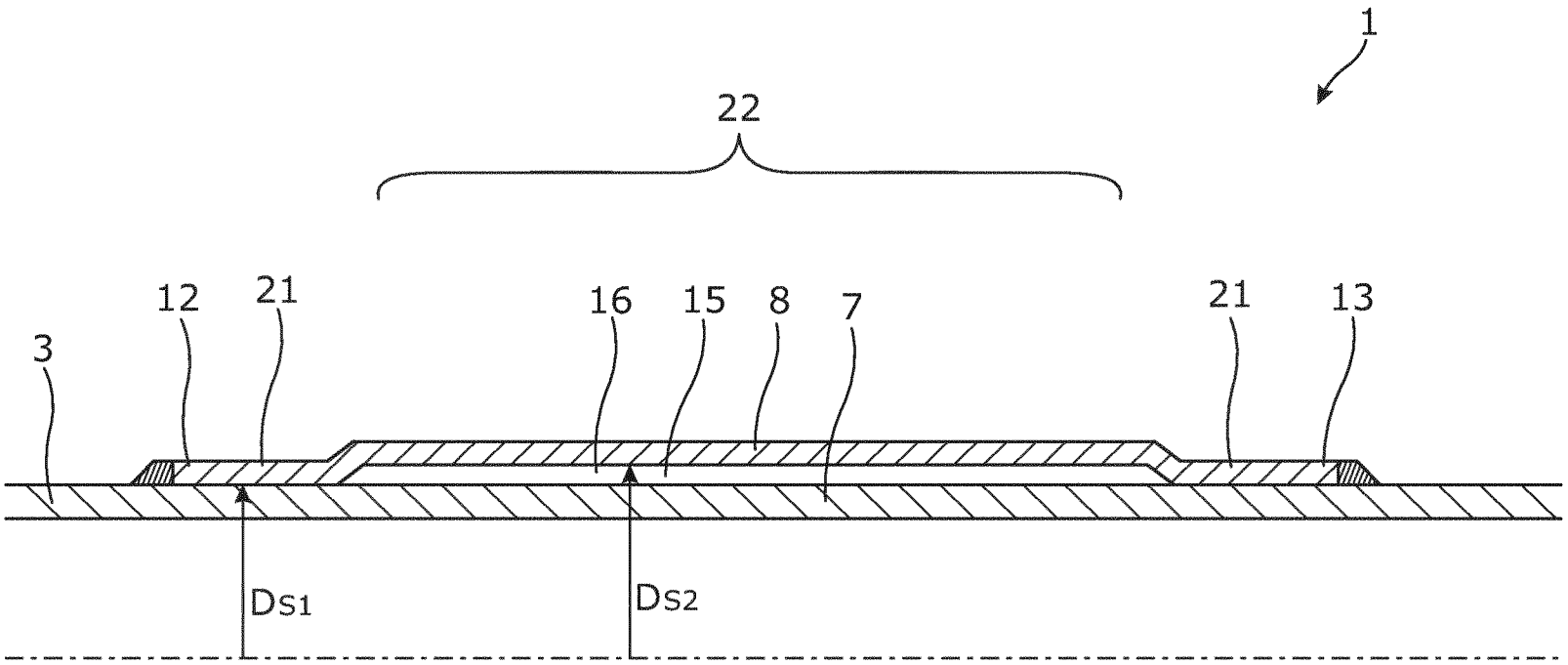
FIG. 2*a* shows a cross-sectional view of an unexpanded annular barrier.

In FIG. 2*a*, the annular barrier 1 is shown in cross-section in its unexpanded condition. The tubular metal part 7 and the expandable sleeve 8 substantially hermetically enclose the annular space 15, and the annular space 15 comprises a compound 16 adapted to expand the annular space 15 increasing the volume of the space and thereby expand the sleeve 8, e.g. when heated to a certain temperature. When expanding the expandable sleeve by an enclosed compound, variations in borehole diameter, e.g. if the inner diameter of the borehole is smaller than expected, may result in an excessive amount of compound being present in the enclosed space compared to what is required. The expandable sleeve will therefore expand more than intended if a known annular barrier is used. Therefore, expandable sleeve 8 is constituted by sections. Two first sections 21 of the sleeve 8 abut the ends 12, 13 of the expandable sleeve 8 being connected with the tubular metal part 7. The thickness of the expandable sleeve in the first and second sections is substantially the same. In the unexpanded condition, the first section of the expandable sleeve has a first inner diameter $D_{S1}$, and the second section of the expandable sleeve has a second inner diameter $D_{S2}$. The second inner diameter is larger than the first inner diameter. When the first inner diameter is smaller than the second inner diameter, the pressure for expanding the sleeve section with the first inner diameter is higher than the pressure required for expanding the section with the second inner diameter. The compound in the annular space generates a certain amount of expansion energy, and if the inner diameter of the borehole is smaller than expected at a location where the annular barrier is to be expanded, there will be an excess of expansion energy. This excess of expansion energy can then be used to also expand the section of the sleeve with the smaller inner diameter. Thus, the first sections of the sleeve function as a passive pressure compensation function, since expansion of this section occurs when there is an excess of expansion energy.

Figure 2B:
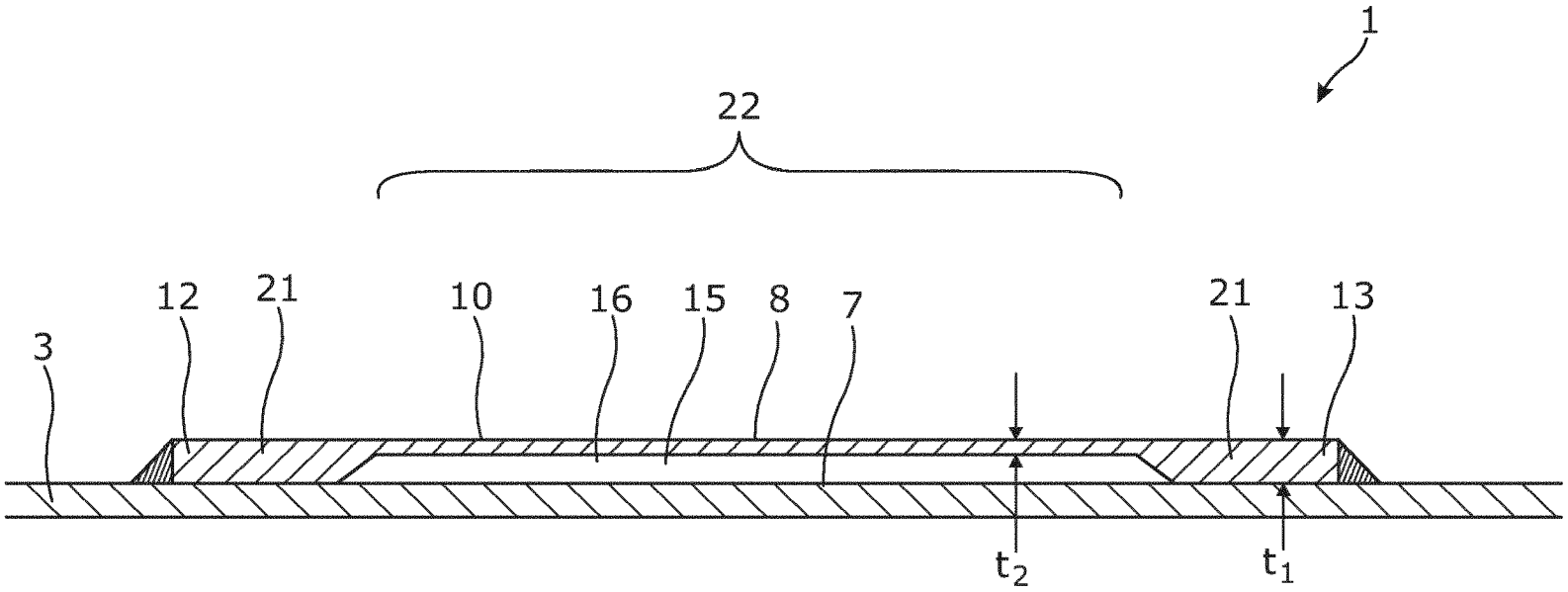
FIG. 2*b* shows a cross-sectional view of another unexpanded annular barrier.

In FIG. 2*b*, the expandable sleeve 8 has the second section 22 between the first sections 21, and the first sections have a first thickness $t_1$ which is larger than a second thickness $t_2$ of the second section 22 in the unexpanded condition of the annular barrier. Thus, a higher expansion pressure is required for expanding the first sections of the sleeve than for expanding the second sections of the sleeve.

Figure 3:
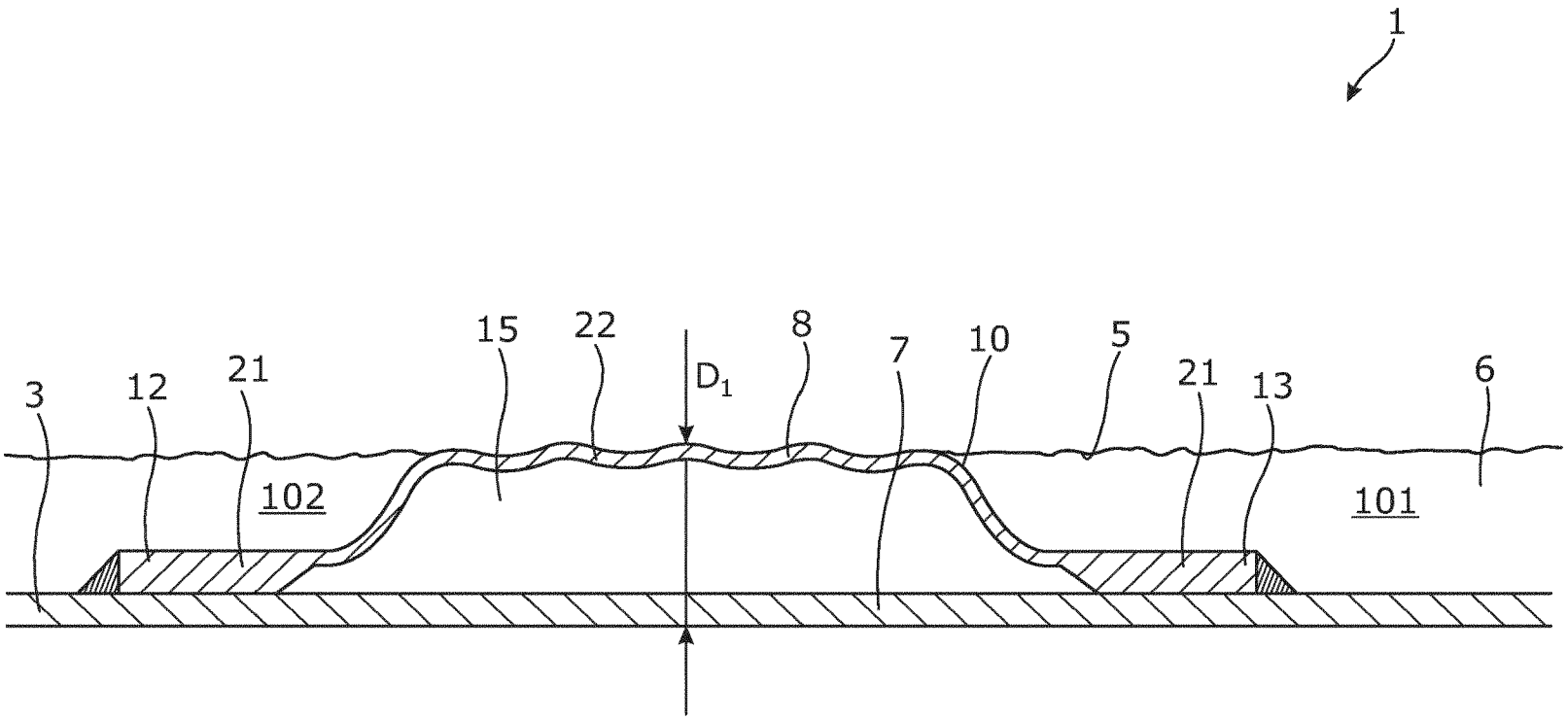
FIG. 3 shows a cross-sectional view of the annular barrier of FIG. 2*b* in an expanded condition.
Figure 4:
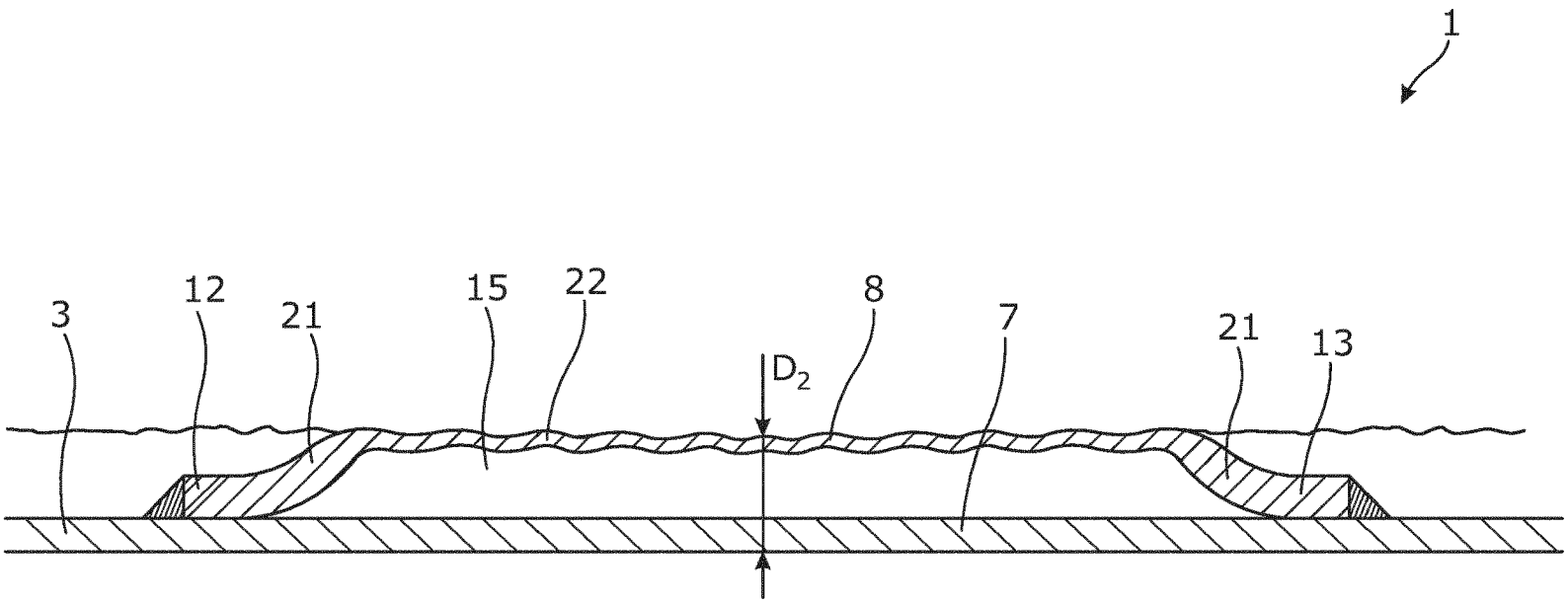
FIG. 4 shows a cross-sectional view of the annular barrier of FIG. 2*b* in an expanded condition in a borehole having a smaller diameter than in FIG. 3.

When the compound entrapped in the expandable space chemically reacts or thermally decomposes, generating gas or super-critical fluid, the expandable sleeve 8 is expanded until the outer face 10 of the sleeve presses towards the inner face 5 of the borehole 6, as shown in FIG. 3. The borehole is drilled to have a certain inner diameter $D_1$ (shown in FIG. 3), but sometimes the diameter of the borehole is smaller than expected as illustrated in FIG. 4 by a second smaller diameter $D_2$. A predetermined amount of compound is dosed to the enclosed space when mounting the annular barrier, and the amount of compound is determined to be capable of expanding the sleeve in a borehole having the expected first inner diameter $D_1$ as shown in FIG. 3. When the inner diameter is smaller than expected, the amount of compound is capable of expanding the sleeve further than needed, since the compound in the space creates more expansion energy than required. And since it is not possible to stop this chemical reaction or decomposition process when it is first initiated, the remaining expansion force of the compound is used to also expand the first sections of the sleeve as shown in FIG. 4. Thus, by having an expandable sleeve with first sections abutting its ends fastened to the tubular metal part, said first sections having a larger thickness than the second sections, the annular barrier having an enclosed amount of compound for expanding the sleeve can be used for a wider range of borehole diameters without the expandable sleeve fracturing.

Figure 5:
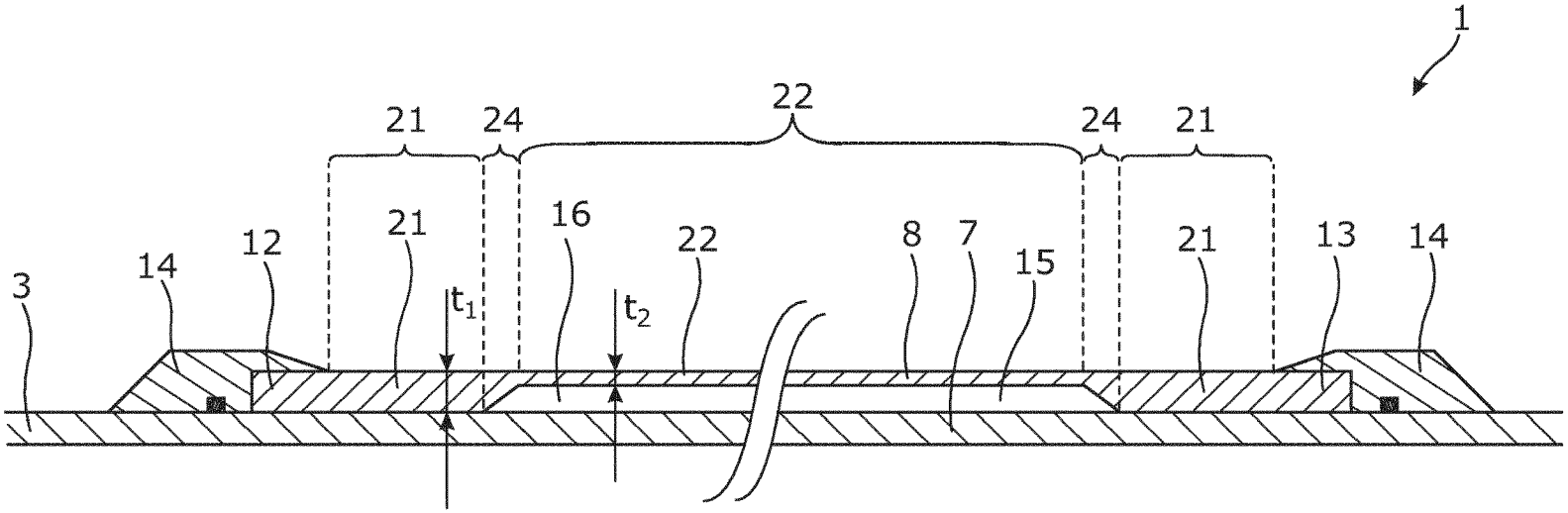
FIG. 5 shows a cross-sectional view of another annular barrier with connection parts.
Figure 6:
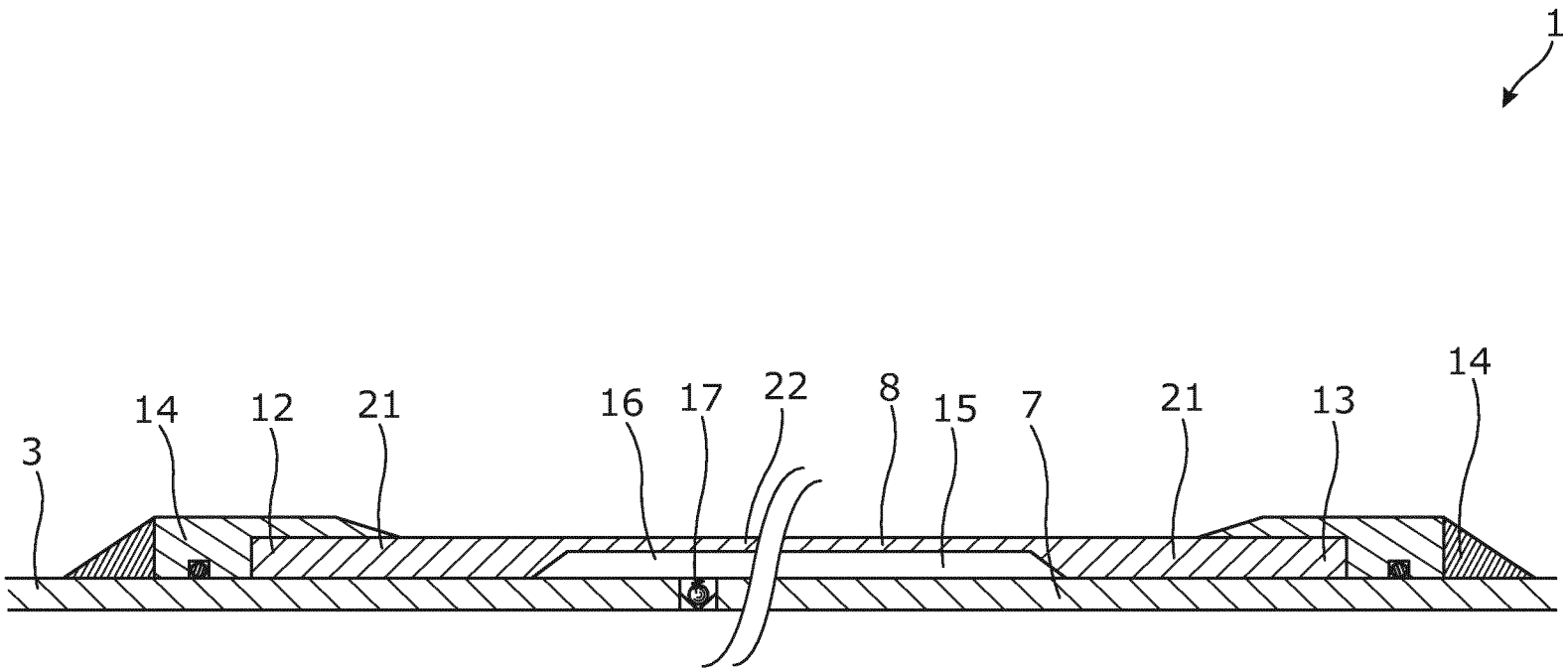
FIG. 6 shows a cross-sectional view of another annular barrier with a one-way valve.
Figure 7:
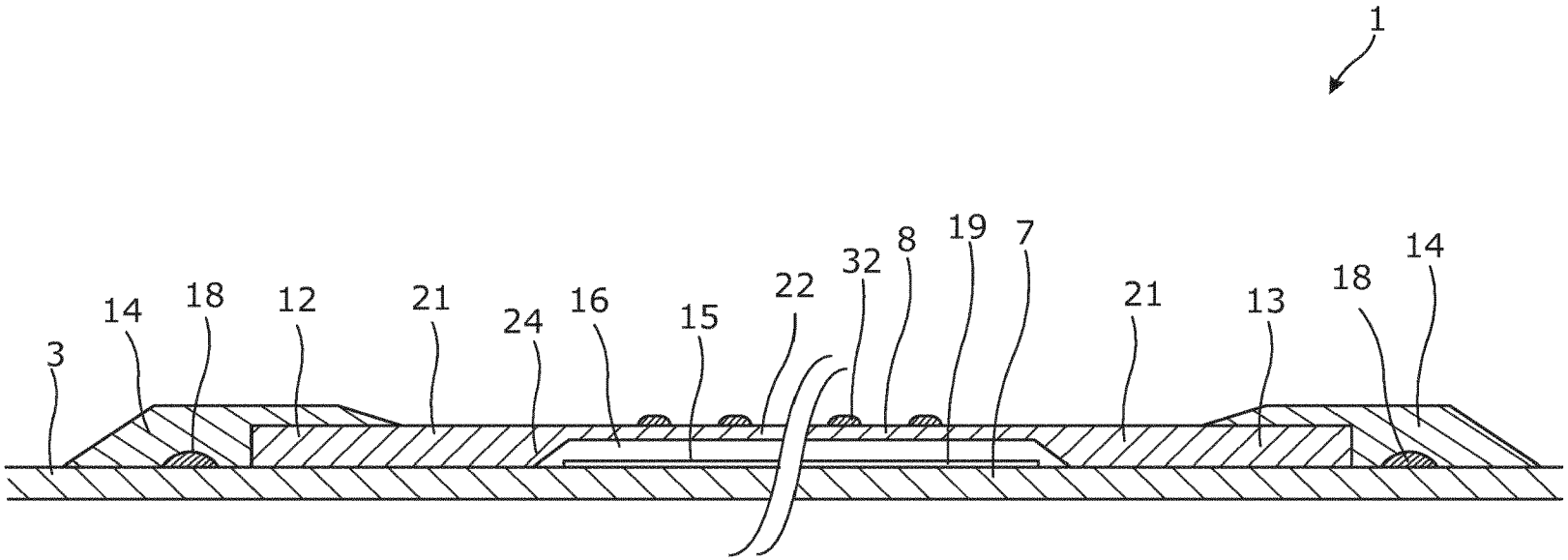
FIG. 7 shows a cross-sectional view of another annular barrier with crimped ends.

When using an enclosed compound 16 in the space 15 and an expandable sleeve 8 made of metal, the expandable sleeve 8 may be welded or in another way fixedly connected to the tubular metal part 7 without connection parts as shown in FIGS. 2-4 and 8. The expandable sleeve 8 may also be connected to the tubular metal part 7 by means of connection parts 14 squeezing around the sleeve 8, so that the sleeve 8 is sandwiched between the connection parts 14 and the tubular metal part 7, as shown in FIGS. 5-7. The connection parts 14 may also be welded onto the tubular part as shown in FIG. 6. Thus, the risk of leaks is further diminished.

One way of expanding the sleeve is when the compound 16 decomposes when heated to above a certain temperature. The compound is then decomposed into gas or super-critical fluid and e.g. water, and as the compound generates gas or super-critical fluid, the volume of the compound increases. In this way, the volume of the space increases, and the expandable sleeve 8 is expanded, as shown in FIG. 3, to provide zone isolation between a first zone 101 and a second zone 102 of the borehole 6. By having a decomposable compound in the space, the expandable sleeve 8 can be expanded without having to apply pressurised fluid in the casing 4 and into the space through an opening in the tubular metal part 7. In this way, the well tubular structure 3 may be designed without openings and other completion components forming part of the well tubular structure and may not be pressurised, which is the case in the known solutions of pressurising a well tubular structure to expand the expandable sleeve.

The compound 16 comprised in the space may comprise nitrogen, such as in the form of ammonium, nitrite, azide, or nitrate, and may be selected from a group of ammonium dichromate, ammonium nitrate, ammonium nitrite, barium azide, sodium nitrate, or a combination thereof. These nitrogen-containing compounds decompose when heated, e.g. by flushing the casing with hot steam or a heated fluid which heats the compound 16 by heating the tubular metal part 7. At many well sites, hot steam is available as it is used for bringing up the hydrocarbon-containing fluid from the reservoir and hot steam can therefore also be used for expanding the annular barriers.

The compound 16 in the space may be present in the form of a powder, a powder dispersed in a liquid or a powder dissolved in a liquid. Thus, the compound 16 may be in a solid or liquid state, e.g. dispersed or dissolved in a liquid, which may be water, mud or well fluid. As the compound 16 is heated, the compound decomposes into gas or super-critical fluid and water, and the expandable sleeve 8 is expanded. Whether it is gas or super-critical fluid depends on the pressure and temperature present downhole. The amount of compound in the space is determined according to the expected pressure downhole and if the pressure is higher than expected, the decomposition could create a super-critical fluid instead of a gas.

As shown in FIG. 5, the first thickness $t_1$ of the first section of the sleeve is at least 50% larger than the second thickness $t_2$ of the second section of the sleeve.

In FIG. 5, the expandable sleeve comprises a transition section 24 between the first section 21 and the second section 22. The transition section 24 has an increasing thickness from the second section 22 to the first section 21. By having a transition section 24 with increasing thickness, notch effect is avoided.

Furthermore, the connection parts overlap the expandable sleeve 8, squeezing the sleeve in between the connection parts and the tubular part. The connection part has a groove in which a sealing means, such as an O-ring, is arranged.

As can be seen from the figures, all sections 21, 22 of the expandable sleeve are made of the same material. Thus, the sections of the expandable sleeve are made when making the expandable sleeve. The sections 21, 22 of the expandable sleeve 8 may be moulded in one piece or machined from one piece. As shown in FIG. 7, the ends 12, 13 of the expandable sleeve 8 are crimped onto the tubular metal part 7. A ring 18 is fastened around the tubular metal part 7 and subsequently, the connection parts 14 are crimped onto the tubular metal part enclosing the rings 18. By crimping is meant that the connection parts are heated, thereby increasing the diameter of the connection parts, and after being arranged around the rings on the tubular metal part, the connection parts 14 are cooled again. Furthermore, sealing elements 32 are arranged on the outer face of the expandable sleeve in order to provide a better seal against the inner face of the borehole.

Figure 9:
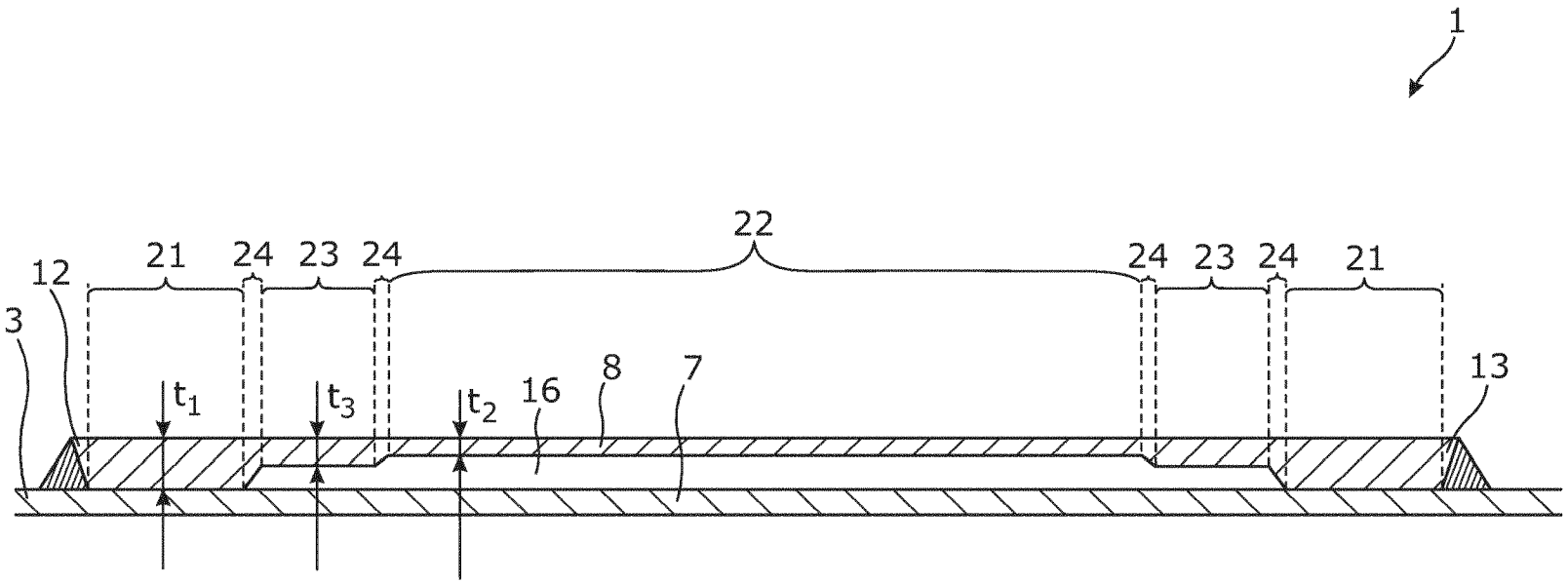
FIG. 9 shows a cross-sectional view of another annular barrier with several sleeve sections.

In FIG. 9, the expandable sleeve 8 comprises a third section 23 between the first section 21 and the second section 22, the third section 23 having a third thickness $t_3$ which is smaller than the first thickness $t_1$ and larger than the second thickness $t_2$. The expandable sleeve further comprises a transition section 24 between the second section 22 and the third section 23 and a transition section 24 between the third section 23 and the first section 21. The transition section has an increasing thickness so that notch effect is avoided.

When expanding the annular barrier 1, the second section 22 is adapted to expand at a first pressure above 65 bar, preferably at least 100 bar, more preferably at least 150 bar, most preferably at least 250 bar, or approximately 345 bar, and the first sections are adapted to expand at a second pressure higher than the first pressure. The second pressure may be at least 100 bar, more preferably at least 250 bar, even preferably at least 350 bar, and most preferably at least 414 bar.

The third section of the annular barrier 1 of FIG. 9 is adapted to expand at a third pressure which is higher than the first pressure but smaller than the second pressure.

In FIGS. 1-5 and 6-9, the tubular metal part 7 does not have any openings, holes or apertures into the annular space. The tubular part thus comprises an outer face, which is continuous.

Figure 8:
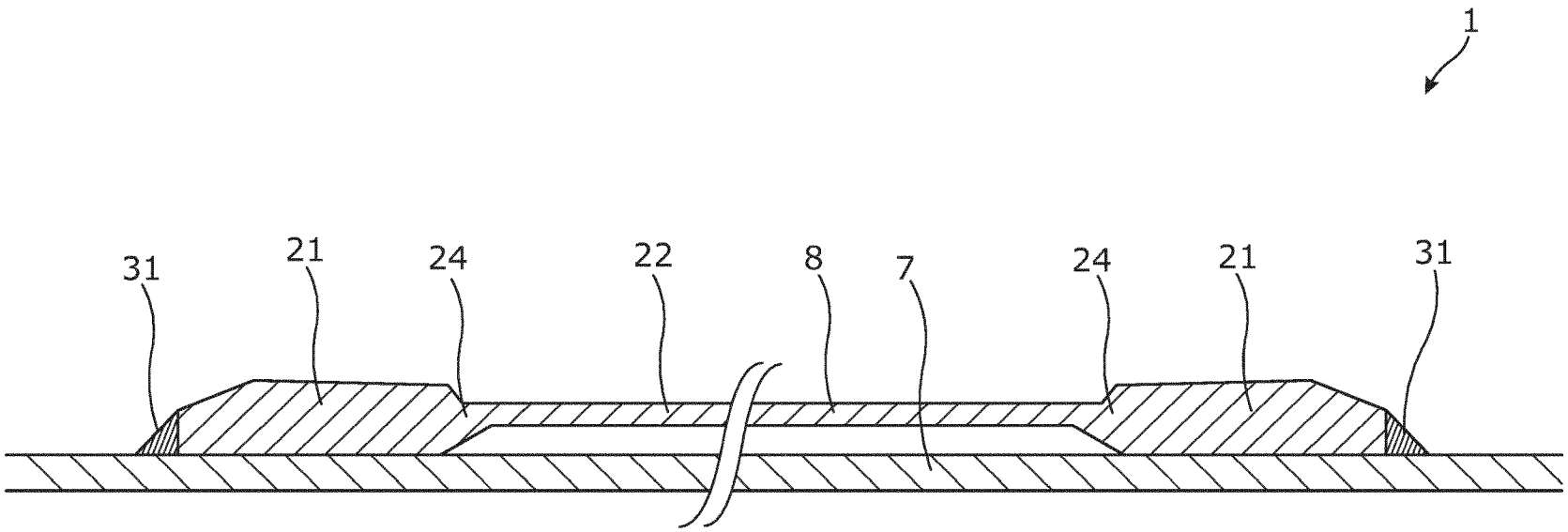
FIG. 8 shows a cross-sectional view of another annular barrier.

In the annular barrier of FIG. 8, the expandable sleeve 8 is fastened to the tubular metal part 7 by means of welding 31, and the first sections 21 of the sleeve has an increasing thickness from the welding 31 towards the second section 22, and then an even thickness before a transition section 24 having a decreasing thickness.

Figure 10:
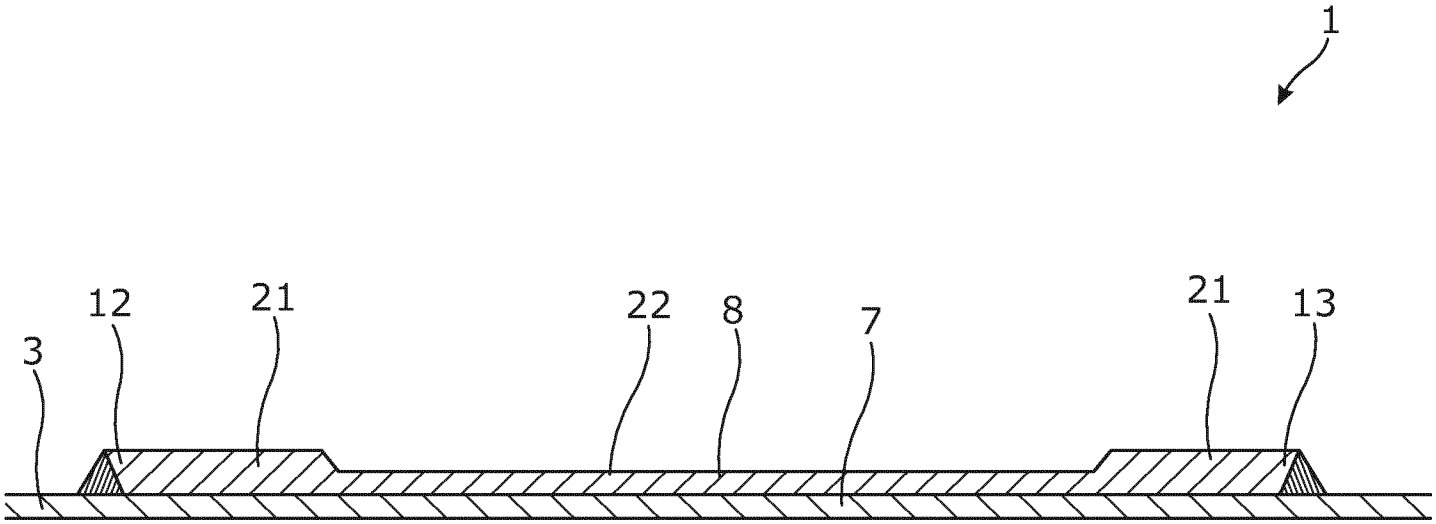
FIG. 10 shows a cross-sectional view of an annular barrier with a larger thickness of the first section.

In FIG. 10, the annular barrier 1 has an expandable sleeve 8 having one inner diameter and a first section 21 having a sleeve thickness larger than the sleeve thickness of the second section 22. The outer diameter of the sleeve is thus larger at the first sections than at the second section. Therefore, the pressure required to expand the first sections is also higher than the pressure required for expanding the second section and thus, the annular barrier has a passive pressure compensation incorporated should the diameter of the borehole vary. In this way, an excess of expansion energy will not result in a collapse of the expandable sleeve or the casing/well tubular structure and/or create fractures in the formation.

Figure 11:
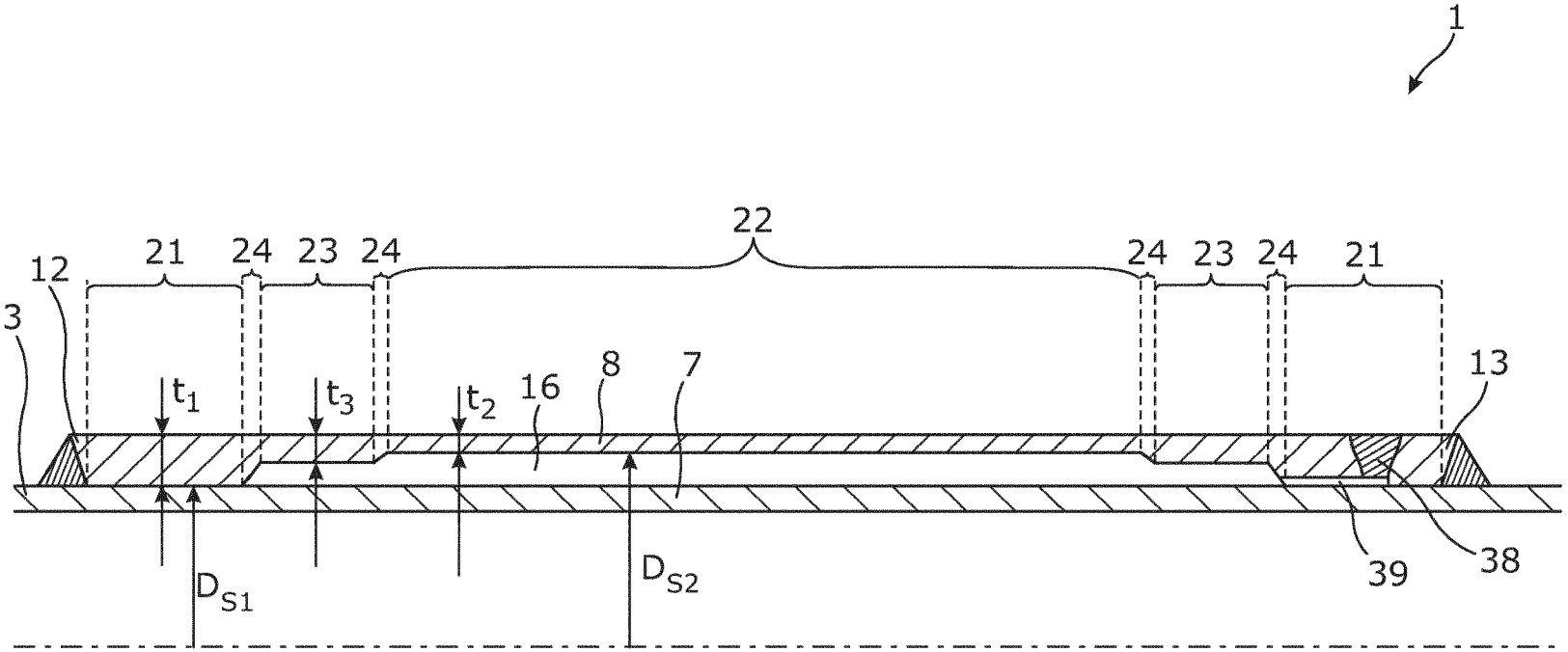
FIG. 11 shows a cross-sectional view of another annular barrier with several sleeve sections and a filling plug.

In order to easily fill the compound in the annular space, the annular barrier of FIG. 11 comprises a filling plug 38 arranged in one of the connection parts. The filling is performed by taking out the plug, and the compound is filled into the space through a channel providing fluid communication to the space. After the filling of compound, the plug is inserted in the connection part again, and the plug may be welded to firmly be fastened to the connection part.

In another embodiment, the first sections of the sleeve have an increasing thickness from the sleeve ends towards the second section of the sleeve. In this way, the first sections have a combination of an increased thickness and inner diameter compared to the second section of the sleeve.

Figure 12:
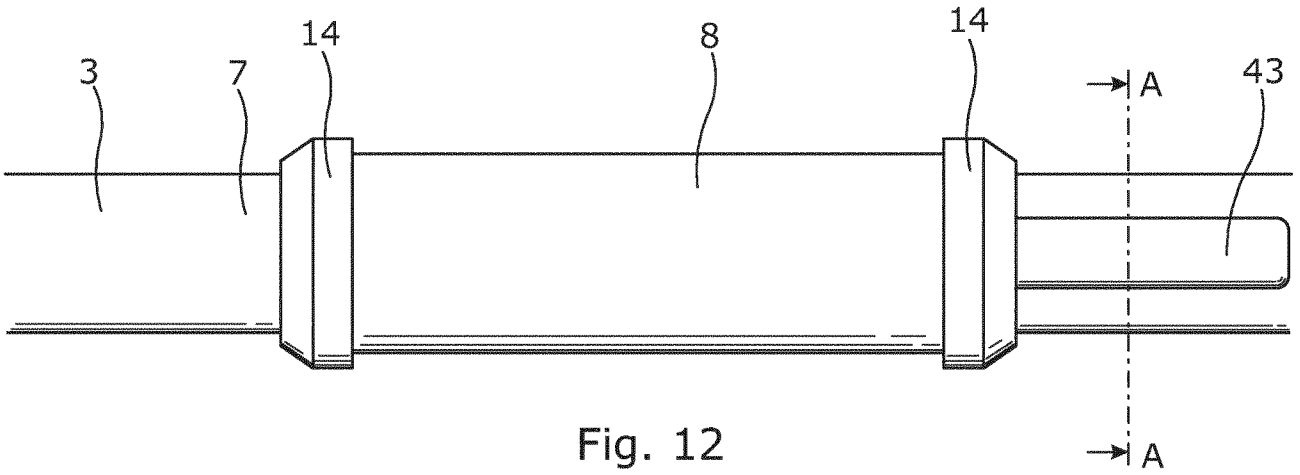
FIG. 12 shows an annular barrier having a pressure compensation unit.
Figure 13:
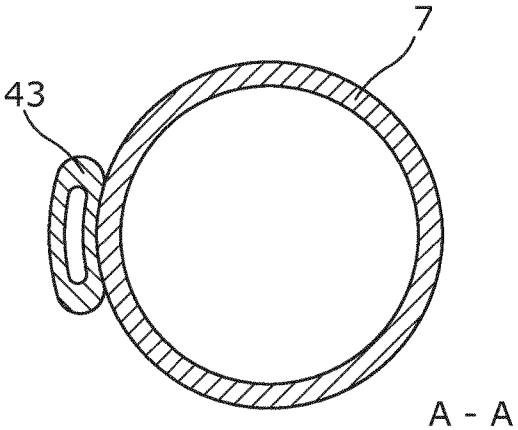
FIG. 13 shows a cross-sectional view of the annular barrier of FIG. 12.

In FIG. 12, the annular barrier further comprises a pressure compensation unit 43 fluidly connected with the space inside the annular barrier but the pressure compensation unit 43 is arranged on the outer face of the tubular part. The pressure compensation unit 43 is a hollow tube as shown in FIG. 13, the tube being closed in one end and arranged along the tubular part 7 and connected with the connection part 14. In FIG. 12, the pressure compensation unit 43 is oval but may have any suitable cross-sectional hollow shape. The hollow pressure compensation unit 43 is fluidly connected with the space between the sleeve and the tubular part 7 through a fluid channel (not shown) in the connection part 14. In this way, any excess of expansion energy can be accumulated in the pressure compensation unit 43, and the pressure compensation unit 43 is thus somewhat expanded. Thus, when having a pressure compensation unit 43, the expandable sleeve of the annular barrier does not need to have a first section with an inner diameter smaller than the inner diameter of the second section, or a thickness of the first section larger than the thickness of the second section. The pressure compensation unit 43 functions as a balloon expandable at a pressure higher than the pressure required for expanding the sleeve. The pressure compensation unit 43 thus has a substantially smaller diameter than the sleeve and may also have a larger thickness.

Figure 14:
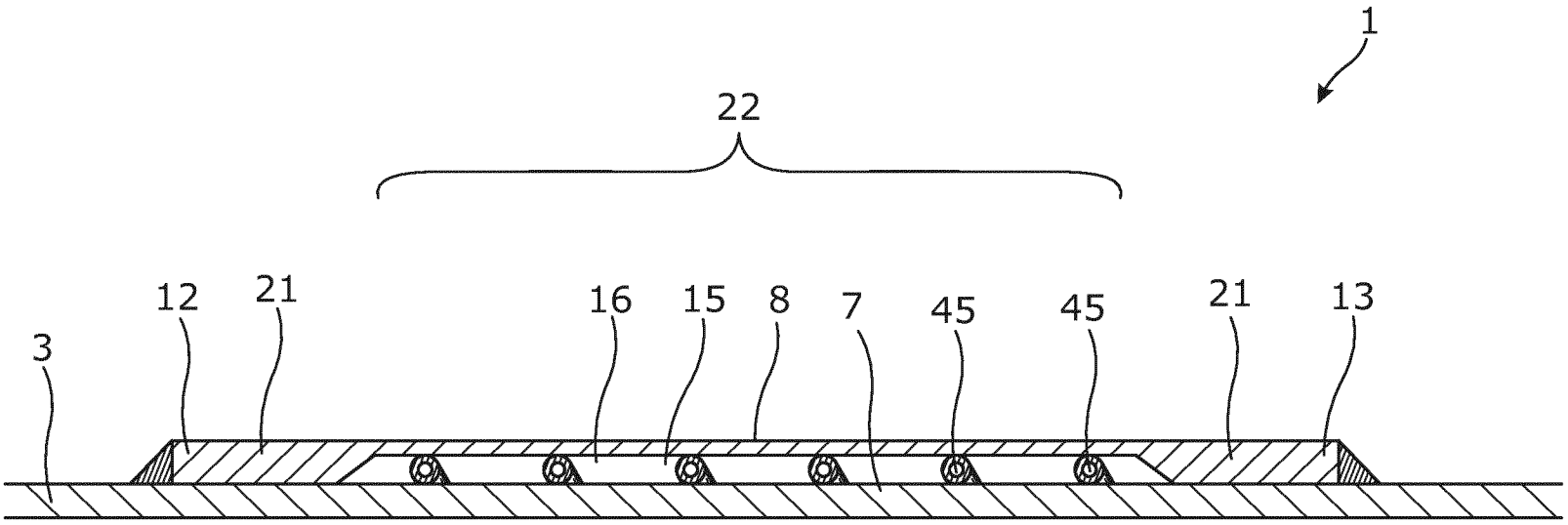
FIG. 14 shows a cross-sectional view of an annular barrier having an anti-collapse element arranged in the space.

In FIG. 14, the annular barrier 1 further comprises an anti-collapsing element 45 arranged in the expandable space 15 between the sleeve 8 and the tubular part 7. The anti-collapsing element is coiled around the tubular part 7 and may be a helical spring or similar helical means. The anti-collapsing element 45 may also be a grid or a mesh which supports the sleeve when the well tubular structure is inserted in the borehole. When inserting the annular barrier, any projections of the borehole may hit against the sleeve and permanently damage the sleeve, or just make the sleeve bulge inwards so that a subsequent expansion of the sleeve requires a higher expansion pressure which is not optimal. Thus, the anti-collapsing element 45 prevents the sleeve from collapsing during insertion of the well tubular structure. The anti-collapsing element 45 is a hollow tube which is capable of collapsing when the compound reacts or decomposes. As the hollow tube collapses, the volume of the space is increased and thus, an excess of expansion energy is used for collapsing the anti-collapsing element 45 instead of collapsing the casing or fracturing the formation.

The compound 16 decomposes when heated to above a certain temperature in a temperature range of 100-400° C. and is then decomposed into gas or super-critical fluid and e.g. water, and as the compound generates gas or super-critical fluid, the volume of the compound increases. In this way, the annular space increases and the expandable sleeve 8 is expanded. The injected steam or heated fluid has a temperature around 250° C. which is sufficient to heat the compound 16 arranged in the space of the annular barrier 1 to above 200° C. Furthermore, the heat can be provided by locally heating the tubular metal part 7 and/or the fluid in the well tubular structure opposite the tubular metal part.

The compound may comprise a catalyst, and by having such a catalyst, the temperature at which the compound decomposes can be increased or decreased depending on the temperature conditions in the borehole. In this way, the annular barrier can be designed for variety of well conditions.

When completing a well, the tubular metal part 7 is mounted as part of the well tubular structure and lowered into the borehole as part of the well tubular structure, e.g. by connecting the well tubular structure to a tubing, such as a drill pipe. Before inserting the annular barriers 1, the annular space may be pre-pressurised to a pressure above 5 bar, preferably above 50 bar and more preferably above 100 bar. By pre-pressurising the annular space 15, the expansion ratio provided by the decomposition of the compound 16 can be decreased, and the expansion can thus be controlled to a higher degree than when the space is not pre-pressurised.

The annular barrier 1 may also comprise a chamber filled with a second compound, and the annular space is filled with the first compound. When the well tubular structure 3 is pressurised, the pressurised fluid moves a piston 41 shearing a shear pin, and the first and the second compounds are mixed into the space through the fluid channel, and the reaction there between expands the sleeve.

The first and second compounds may be calcium carbonate and hydrochloric acid which, when mixed, react (and do not decompose) and generate calcium chloride, water and carbon dioxide and thereby create an increased pressure resulting in an expansion of the annular barrier 1.

In another embodiment, the annular space comprises several chemicals which are already mixed into the compound and which react when heated to a certain temperature and thermally decompose.

Furthermore, the first and second compounds could be chemicals mixed into the annular space and could be diesel and oxygen, e.g. in the form of air, reacting and not decomposing at a temperature of 210° C., and thereby creating an expansion of the expandable sleeve. The chemicals, i.e. the first and second compounds, could also be diethyl ether and oxygen, e.g. in the form of air, reacting at a temperature of 160° C.

Also, the annular space may comprise more than one chemical, and a spark or electrical ignition could start a chemical reaction (not decomposition) between the chemicals, creating an increased volume resulting in an expansion of the annular barrier 1. The chemicals could be sodium chlorate, barium peroxide and potassium perchlorate.

In addition, the annular space may be filled with water, and by using electricity through wires on the outside of the well tubular structure 3, hydrogen and oxygen are generated via electrolysis.

As shown in FIG. 6, the annular barrier 1 further comprises a one-way valve 17 arranged in the tubular metal part 7 controlling the inlet of fluid from the inside of the well tubular structure so that the fluid is allowed to flow into the space but not out of the space, e.g. during expansion.

In order to heat the compound 16 in the space of the annular barrier 1 locally, the tubular metal part 7 further comprises a heating wire 19, such as an electric wire, arranged in an abutment to the tubular metal part 7 as shown in the cross-sectional view of FIG. 7. The wire 19 may be arranged in grooves or may be embedded in the tubular metal part 7. The wire 19 may be a mesh arranged in the space surrounding the tubular metal part 7. Electricity may be wirelessly applied to the wire 19, e.g. by means of induction or by a fluid-tight electrical contact. Furthermore, the electrical wire may run on the outside of the well tubular structure 3 up to surface.

The downhole system 100 shown in FIG. 1 comprises the well tubular structure 3 in the form of a casing 4 and two annular barriers 1. The system 100 further comprises a tool 50 comprising a heating unit 51 for heating the tubular metal part 7 of the annular barrier 1 from within the well tubular structure 3. The tool 50 comprises an isolation means, such as inflatable seals 55, a pump 56 for inflating the seals, a motor 57 for driving the pump, and an electronic section 58 connected to a wireline 60. The heating unit 51 heats the well fluid surrounding the tool 50, and the heated fluid is prevented from mixing with the cooler well fluid because the seals 55 entrap the fluid to be heated. As the entrapped fluid is heated, the tubular metal part 7 and thus the compound 16 in the space are heated. When the compound 16 reaches a certain temperature, the compound decomposes, and the sleeve 8 is expanded. Then, the seals of the tool 50 are deflated and the tool is moved upwards along the adjacent annular barrier 1 to expand this annular barrier as well. The tool 50 may also heat the entrapped fluid by sucking in the fluid, letting it flow past a heat exchanger in the tool and discharging the heated fluid. Thus, the heating unit 51 may be an immersion heater, a heat exchanger, a blower or similar heating element.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and a wall of a borehole downhole for providing zone isolation between a first zone and a second zone of the borehole, the annular barrier comprising:

a tubular metal part for mounting as part of the well tubular structure, an expandable sleeve surrounding the tubular metal part and having an inner face facing the tubular metal part and an outer face facing the wall of the borehole, each end of the expandable sleeve being connected with the tubular metal part, and an annular space between the inner face of the expandable sleeve and the tubular metal part, wherein the tubular metal part and the inner face of the expandable sleeve substantially hermetically enclose the annular space, the annular space comprising a compound substantially hermetically enclosed in the annular space in an unexpanded condition of the annular barrier, the compound being adapted to expand the annular space while substantially hermetically enclosed in the annular space, and wherein the expandable sleeve comprises two first sections abutting the ends of the expandable sleeve and a second section between the first sections, the first sections and the second section of the expandable sleeve having a one-piece construction, each first section of the expandable sleeve having a first inner diameter in the unexpanded condition of the annular barrier, and the second section of the expandable sleeve having a second inner diameter in the unexpanded condition, which second inner diameter is larger than the first inner diameter in the unexpanded condition, or the first sections have a first thickness which is larger than a second thickness of the second section in the unexpanded condition.

2. The annular barrier according to claim 1, wherein the first sections have an increasing thickness.

3. The annular barrier according to claim 1, wherein the compound comprises at least one thermally decomposable compound adapted to generate gas or super-critical fluid upon decomposition, the thermally decomposable compound decomposing at a temperature below 400° C.

4. The annular barrier according to claim 1, wherein the ends of the expandable sleeve are welded to the tubular part.

5. The annular barrier according to claim 1, wherein the expandable sleeve comprises a transition section between at least one of the first sections and the second section, the transition section having an increasing thickness from the second section to the first section.

6. The annular barrier according to claim 1, wherein the expandable sleeve comprises a third section between the at least one of the first sections and the second section, the third section having a third thickness which is smaller than the first thickness and larger than the second thickness, the third section of the expandable sleeve having the one-piece construction with the first sections and the second section.

7. The annular barrier according to claim 6, wherein the expandable sleeve comprises a first transition section between the second section and the third section and a second transition section between the third section and the first section.

8. The annular barrier according to claim 6, wherein the third section having the third thickness has a uniform cross-section extending parallel to a longitudinal axis of the expandable sleeve in the unexpanded condition of the annular barrier.

9. The annular barrier according to claim 1, wherein the second section is adapted to expand at a first pressure above 300 bar, preferably above 325 bar, more preferably at a pressure of approximately 345 bar, and the first sections are adapted to expand at a second pressure which is higher than the first pressure.

10. The annular barrier according to claim 1, wherein the compound comprises nitrogen.

11. The annular barrier according to claim 1, wherein the compound is selected from a group consisting of: ammonium dichromate, ammonium nitrate, ammonium nitrite, barium azide, sodium nitrate, or a combination thereof.

12. The annular barrier according to claim 1, wherein the compound is present in the form of a powder, a powder dispersed in a liquid or a powder dissolved in a liquid.

13. The annular barrier according to claim 1, further comprising a heating wire arranged in the tubular metal part or in an abutment to the tubular metal part.

14. A downhole system comprising:

the well tubular structure, and the annular barrier according to claim 1.

15. The downhole system according to claim 14 further comprising a plurality of annular barriers.

16. The downhole system according to claim 14, wherein the well tubular structure is filled with a fluid having a temperature above 110° C., preferably a temperature above 180° C., and more preferably a temperature above 250° C.

17. The downhole system according to claim 14, further comprising a tool comprising a heating unit for heating the tubular metal part of the annular barrier from within the well tubular structure.

18. The downhole system according to claim 17, wherein the tool comprises isolation means for isolating a zone in the well tubular structure opposite the expandable space of the annular barrier.

19. The downhole system according to claim 17, wherein the heating unit of the tool comprises a heating wire adapted to be arranged in abutment to the tubular metal part.

20. The downhole system according to claim 14, wherein the well tubular structure is connected to a tubing, such as a drill pipe, for submerging the well tubular structure, the tubing being connected with a heating device at surface or seabed.

21. A method of expanding the annular barrier according to claim 1 comprising:

activating the compound in the annular space so that the annular space starts to expand, thereby causing the second section of the expandable sleeve to expand by a first pressure, and expanding the first sections of the expandable sleeve if the first pressure exceeds a second pressure.

22. The annular barrier according to claim 1, wherein the first thickness is at least 50% larger than the second thickness.

23. The annular barrier according to claim 1, wherein the tubular metal part does not have any openings, holes, or apertures into the annular space.

* * * * *